United States Patent [19]

Green et al.

[11] 4,300,734

[45] Nov. 17, 1981

[54] PACKAGED STRAND

[75] Inventors: William A. Green, Swanton; William B. Parsons, Sylvania, both of Ohio

[73] Assignee: Owens-Corning Fiberglas Corporation, Toledo, Ohio

[21] Appl. No.: 198,689

[22] Filed: Oct. 20, 1980

[51] Int. Cl.[3] ..... B65H 55/02

[52] U.S. Cl. ..... 242/170; 206/410; 242/18 G; 242/146; 242/172

[58] Field of Search ..... 242/159, 163, 170, 171, 242/146, 18 R, 18 G, 172, 173; 206/389, 398, 410

[56] References Cited

U.S. PATENT DOCUMENTS

| | | | |
|---|---|---|---|
| 1,889,011 | 11/1932 | Baumhuter | 242/146 |
| 1,915,843 | 6/1933 | Wright | 242/146 |
| 1,948,438 | 2/1934 | Brunet et al. | 242/18 R |
| 2,552,594 | 5/1951 | Scott, Jr. | 242/171 |
| 2,716,008 | 8/1955 | Taylor, Jr. | 242/163 |
| 2,720,309 | 10/1955 | Kimball | 242/171 |
| 4,220,295 | 9/1980 | Green et al. | 242/170 |

FOREIGN PATENT DOCUMENTS

| | | | |
|---|---|---|---|
| 857737 | 1/1961 | United Kingdom | 242/170 |

*Primary Examiner*—Stanley N. Gilreath
*Attorney, Agent, or Firm*—Ronald C. Hudgens; Philip R. Cloutier; Greg Dziegielewski

[57] ABSTRACT

In a package having a wound body of strand having an outer cylindrical portion and an elastic membrane convolutely wound about the cylindrical portion in a plurality of plies, the membrane being of a sufficient thickness and being stretched sufficiently to partially collapse as the strand is withdrawn from the interior of the body, such that the membrane mechanically captures the strand of the outer cylindrical portion to retain such strand along said membrane until said strand is withdrawn from the package wherein the improvement comprises: a control layer of material having different physical characteristics than said membrane, said control layer being positioned between the plies of said membrane to control the collapse of said membrane to a predetermined amount.

6 Claims, 6 Drawing Figures

PACKAGED STRAND

BACKGROUND OF THE INVENTION

A number of systems have been developed for winding strand into a cylindrical package and subsequently encasing the wound package in a membrane to protect the strand and to facilitate withdrawal of the strand from the package.

A number of such systems included thermally shrinking a plastic or polymeric membrane over the outer surface of the wound body of the strand. Although such systems did improve the run-out capabilities of the package, a tendency for the outermost layer of the strand to collapse in a ball or "bird's nest" still existed. That is, as a strand was withdrawn from the package working from the inside diameter of the package to the outer diameter of the package, the outermost layers exhibited a tendency to collapse and tangle and, thus, preclude continuous operation and complete utilization of the strand.

Other systems incorpoated an adhesive between the membrane and the outer layer of strand to retain the strand against the membrane wall. In a number of instances, the adhesive contaminated the strand, among other problems.

Another system disclosed in U.S. Pat. No. 4,220,295 incorporated an elastic membrane wound about the cylindrical portion of the package of strand, wherein the membrane is wound to a thickness and is stretched sufficiently to partially collapse when the strand is withdrawn from the package, such that the membrane mechanically captures the outer layer of strand of the body of strand.

Such a system works well in many instances; however, in some situations, primarily when the withdrawal speed of the strand is very high, the package can collapse with extreme non-uniformity due to the dynamic forces generated by a rapidly whiping strand. Also, there is a tendency of the strand, when being withdrawn at high speed to loop over the exterior of empty packages and snare such package when the empty packages are not removed from a creel-type operation, thus interrupting the pay out of strand.

The present invention comprises a modification to the system disclosed in U.S. Pat. No. 4,220,295.

SUMMARY OF THE INVENTION

A package and a method for producing the package are provided comprising a wound body of strand having an outer cylindrical portion, and an elastic membrane wound about the cylindrical portion of said body, the membrane being wound to a sufficient thickness and stretched sufficiently to partially collapse as said strand is withdrawn from the body, such that the membrane captures portions of the strand along the outer cylindrical portion of the body to retain the strand along said membrane until said strand is withdrawn from the package wherein the improvement comprises a sheet of paper-like material positioned between the plys of the membrane to control the amount of membrane collapse.

It is an object of this invention to provide an improved package system for encapsulating wound filamentary material.

It is another object of the present invention to provide a method for applying a membrane to a predetermined thickness in a predetermined stretched condition having a control layer positioned between the plys of the membrane.

The foregoing, as well as other objects of the present invention, will become apparent to those skilled in the art in the following detailed description.

DESCRIPTION OF THE INVENTION

Figure 1:
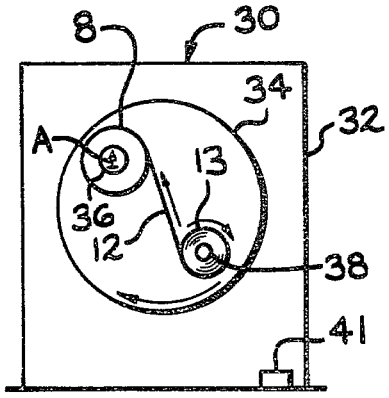
FIG. 1 is a semi-schematic front view of a system for wrapping an elastic membrane and a control layer around a package of strand.
Figure 2:
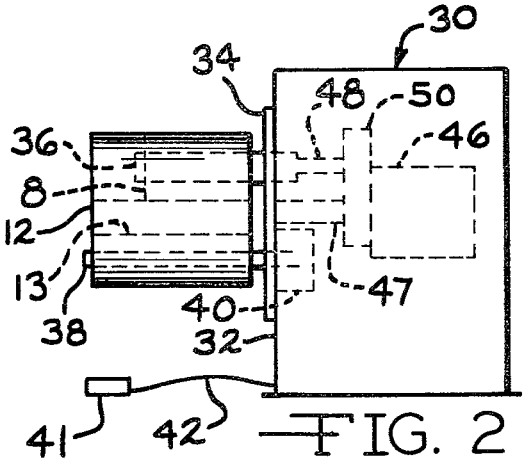
FIG. 2 is a side view of the system shown in FIG. 1.
Figure 3:
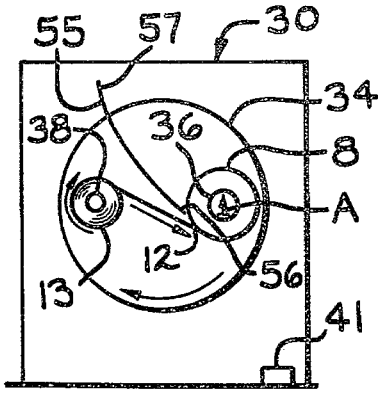
FIG. 3 is a front view of the system shown in FIG. 1 at a different point during package wrap.

As shown in FIGS. 1, 2 and 3, a cylindrically shaped, wound package of strand 8 having an external cylindrical portion 11 is positioned on wrapping means 30.

Elastic membrane 12 is supplied to package 8 from roll of membrane material 13. Elastic membrane 12 can be of any suitable material of a sufficient thickness and capable of being stretched to the proper extent. Polymeric membranes of such materials as polyvinylidene chloride and polyvinyl chloride are preferred in thickness from about 0.0006 inch to about 0.003 inch.

Basically, the elastic membrane 12 and control layer 55 are wound about the cylindrical portion 11 of wound body of strand 8, the membrane being applied at a sufficient thickness and being stretched or tensioned sufficiently to partially collapse when the strand is withdrawn from the interior of the body 8, such that the membrane 12 captures portions of the strand of the outer cylindrical portion 11 to retain such strand along the membrane until the strand is withdrawn from the package at a predetermined time.

Control layer or sheet 55 can be of any suitable material such as paper, fibrous glass sheets, or polymeric type sheets. The sheet 55 should have sufficient rigidity to control the collapse of membrane 12; that is, control layer 55 should have different physical characteristics from membrane 12 to provide a substantially uniform controlled collapse of membrane 12.

Wrapping means 30 is comprised of a frame 32 and a rotatable member 34 associated therewith. The first collet 36 is rotatably journaled in member 34 and is adapted to receive body 8 thereon. Second collet 38 is rotatably journaled in member 34 and is adapted to receive roll 13 thereon. Member 34 is adapted to be rotated by motor 46. Positioning means or gear train 50, which can be attached to the housing of motor 46, is joined with shaft 48 of collet 36 such that as member 34 is rotated, body 8 and collet 36 maintain the same general unrotated orientation with respect to frame 32. As can be seen by FIGS. 1 and 3, arrow A, which points vertically upward on package 8 in FIG. 1, remains pointing vertically upward completely throughout the rotation of member 34.

A second collet 38, which is rotatably journaled in member 34, is attached to adjustable braking means 40 to apply a predetermined amount of drag to second collet 38, such that membrane 12 is wrapped about body 8 under a predetermined amount of tension to stretch membrane 12. Brake means 40 can be of any suitable type such as a pneumatic or electrodynamic brake as is known in the art. Brake means 40 is adjustably controlled by control means 41 via connection 42 as is known in the art.

During the wrapping of the membrane 12 about body 8, sheet 55 is inserted between the portion of the membrane 12 wrapped on body 8 and the portion of membrane 12 about to be wrapped on package 6. Sheet 55 should have a width approximately equal to the axial length of body 8, and sheet 55 should have a length approximately equal to the circumference of body 8 to provide about 1 full layer of sheet 55 about the circumferential exterior surface of body 8.

More than 1 full wrap of sheet 55 can be applied, if desired, but it may not be necessary depending upon the type of material employed.

Alternatively, wound body 8 can be mounted on a driven rotatable collet. Membrane 12 can be pulled from a roll mounted on another collet as the body 8 is rotated. Also, the roll and the collet associated therewith could have a brake means to apply sufficient amount of tension to membrane 12 as it is being wound around the cylindrical portion 11 of body 8. Sheet 55 would be inserted between the plys of membrane 12, as disclosed above.

Figure 4:
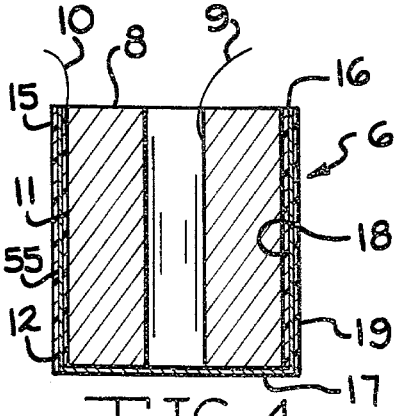
FIG. 4 is a cross-sectional view of a package according to the principles of this invention.

As shown in FIG. 4, one end 16 of package 6 is substantially open with the opposite end 17 being substantially closed. It is believed that membrane 12 should project no further than approximately ½ inch radially inward from the cylindrical shell 15 at the open end of the package to facilitate complete, continuous run-out of the strand. Preferably, first strand end 9 positioned in the hollow core of body 8 is adapted to be pulled out through the open end 16 of the package 6. Second strand end 10 can be located along the external cylindrical portion 11 of body 8. For continuous operation, end 10 can be tied to another end of a second package to permit continuous operation. In creel-type operations, a plurality of packages are positioned in a generally rectangular array. For example, a creel section can consist of a set of packages stacked 3 packages across and 4 packages high. If the empty packages are not removed during operation, the instant invention substantially reduces the tendency of the running strand to snare an empty package and thus disrupt strand payout.

As shown in FIG. 4, the cylindrical shell 15 formed by membrane 12 and control layer 55, according to the principles of this invention, is in intimate compressive contact with the external cylindrical portion 11 of body 8.

Closed end 17 can be formed by supplying a sheet of membrane 12 substantially longer than the length of body 8, as shown in FIG. 2, and folding the excess membrane over the end to form closed end 17. Open end 16 is formed by positioning one end of body 8 and one end of roll 13 in a common vertical plane and maintaining this relationship during wrapping, as can be seen in FIG. 2.

Figure 5:
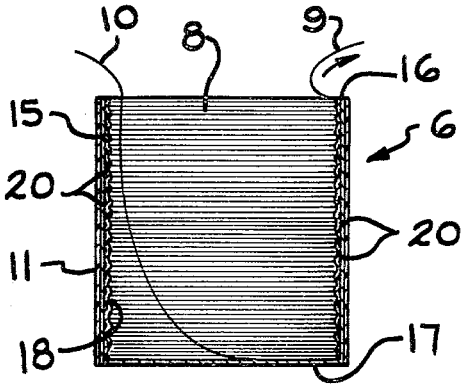
FIG. 5 is a front view of the package just prior to the complete run-out of the strand from the package.

As shown in FIG. 5, the inner section 18 of cylindrical shell 15 develops a plurality of undulations, crinkled sections or ridges due to the relaxation of the tension on membrane 12, as well as the weight of the shell 15 and unsupported outer layers of strand as the strand is almost completely withdrawn from package 6. The crinkles or corrugations 20 have been found to mechanically grasp or crimp portions of the strand at the outer cylindrical portion of body 8 to retain such portions of the strand along the inner layer 18 shell 15 of membrane 12 until the strand is withdrawn from the package in a predetermined manner.

It has been found that exterior layer 19 of shell 15 collapses substantially less than the membrane of the system disclosed in aforementioned U.S. Pat. No. 4,220,295. The amount of radial contraction of exterior layer 19 of shell 15 is also reduced by control layer 55. However, inner layer 18 of membrane 12 still collapses to mechanically grasp the outer layer of strand of package 6 during run-out, but the amount of axial collapse is substantially reduced. That is, radial collapse of inner layer 18 is predominant.

It has been found that a tensile force within the range from about 2 to about 4 pounds applied to membrane 12 as it is being wound around body 8 for a plurality of convolutions having a width within the range from about 17 to 24 inches and having a thickness within the range from about 0.0006 inch to about 0.003 inch plus control layer 55 applied to a package of wound glass strand approximately 11 inches long and 12 inches in diameter provides a package having improved strand run-out characteristics for high speed operation.

As such, the tension applied to membrane 12 during winding should be within a range from about 0.08 pounds per inch of width of membrane to about 0.24 pounds per inch of width of membrane for acceptable results. The number of wraps of membrane is dependent upon the characteristics of the particular membrane and body of strand.

It has been found that a single sheet of conventional wood pulp type paper, specifically #30 kraft paper, can provide the proper amount of controlled collapse desired.

Figure 6:
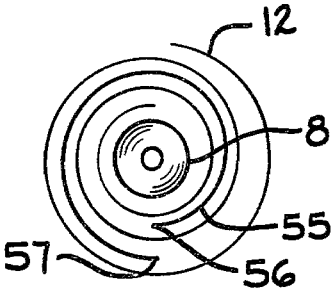
FIG. 6 is a schematic axial view of the layers of the package according to the principles of this invention.

As shown in FIG. 6, body of strand 8 is first convolutely wrapped with about one to about two layers of membrane 12. As such, these layers or plies comprise inner section 18. Preferably, inner section is comprised of about 1½ wraps of membrane 12 or enough so that the inner layers adhere to each other to form an integral protective layer.

Once the inner section or layer 18 is completed, control layer or sheet 5 is inserted as shown in FIG. 3. That is, first edge or end 56 of sheet 55 is inserted between the membrane 12 wrapped about body 8 and the portion of membrane 12 about to be wrapped on body 8 as membrane 12 is continuously wound around body 8. Thus, control layer 55 is wound about body 8 simultaneously with membrane 12 for a portion thereof. Control layer 55 can extend from about ¾ to about 2 times around the circumference of body 8, with an approximately single wrap of sheet 55 being preferred.

As shown in FIG. 6, control layer extends approximately 1 revolution with membrane 12 extending approximately ½ revolution beyond end 57. As such approximately 3 wraps or plies of membrane 12 are employed with about 1 wrap or ply of sheet 55 therebetween.

The membrane 12 and sheet 55 are then simultaneously wrapped about body 8. Membrane 12 is wrapped beyond second end or edge 57 of sheet 55 about ¼ to about 2 wraps to comprise the outer section 19 of membrane 12. Preferably membrane 12 is wrapped about ½ revolution about body 8 beyond edge 57. The membrane 12 is additionally so wrapped such that the membrane layers at outer section 19 adhere to each other to form an integral package 6.

Thus, membrane 12 is unbroken throughout the package 6, with sheet 55 being inserted at a predetermined point during the wrapping cycle.

Package 6 produced according to the instant invention provides improved strand run-out characteristics for high speed systems over a "stretched membrane" system as disclosed in the aforementioned patent. Further, the package is produced in the absence of "heat-shrinking" the membrane 12 as is known in the art. It has been found that "heat-shrinking" a polymeric membrane generally provides a shell or membrane not having the proper collapse characteristics to sufficiently capture the strand between the folds to retain the strand along the membrane.

Also, the membrane 12 should be of the type having a static electrical charge adapted to attract the strand to help retain the strand along membrane 12.

It is apparent that within the scope of the invention, modifications and different arrangements can be made other than as herein disclosed. The present disclosure is merely illustrative with the invention comprehending all variations thereof.

We claim:

1. In a package having a wound body of strand having an outer cylindrical portion and an elastic membrane convolutely wound about the cylindrical portion in a plurality of plies, the membrane being of a sufficient thickness and being stretched sufficiently to partially collapse as the strand is withdrawn from the interior of the body, such that the membrane mechanically captures the strand of the outer cylindrical portion to retain such strand along said membrane until said strand is withdrawn from the package wherein the improvement comprises: a control layer of material having different physical characteristics than said membrane positioned between the plies of said membrane to control the collapse of said membrane to a predetermined amount.

2. The package of claim 1 wherein said control layer is selected from the group consisting of paper, polymer, and fibrous glass.

3. The package of claims 1 or 2 wherein the membrane is present in about 1 to about 2 wraps between said body of strand and said control layer.

4. The package of claim 3 wherein said control layer encircles from about $\frac{3}{4}$ to about 2 times the circumference of the body.

5. The package of claim 4 wherein said membrane is wrapped from about $\frac{1}{4}$ to about 2 times beyond said control layer.

6. In the method of forming a package having a wound body of strand having an outer cylindrical portion and an elastic membrane convolutely wound about the cylindrical portion in a plurality of plies, the membrane being of a sufficient thickness and being stretched sufficiently to partially collapse as the strand is withdrawn from the interior of the body such that the membrane mechanically captures the strand of the outer cylindrical portion to retain such strand along said membrane until said strand is withdrawn from the package wherein the improvement comprises: providing a control layer of material having different physical characteristics than said membrane between the plies of said membrane to control the collapse of said membrane to a predetermined amount.

* * * * *